US006028576A

United States Patent [19]

Hush

[11] Patent Number: 6,028,576

[45] Date of Patent: Feb. 22, 2000

[54] MATRIX ADDRESSABLE DISPLAY HAVING COMPENSATION FOR ACTIVATION-TO-EMISSION VARIATIONS

[75] Inventor: Glen E. Hush, Boise, Id.

[73] Assignee: Micron Technology, Inc., Boise, Id.

[21] Appl. No.: 08/726,293

[22] Filed: Oct. 4, 1996

[51] Int. Cl.[7] ..... G09G 3/22

[52] U.S. Cl. ..... 345/74

[58] Field of Search ..... 345/74, 76, 55, 345/72, 77, 75; 315/169.1, 169.3

[56] References Cited

U.S. PATENT DOCUMENTS

| | | | |
|---|---|---|---|
| 4,020,280 | 4/1977 | Kaneko et al. | 348/797 |
| 5,262,698 | 11/1993 | Dunham | 315/169.1 |
| 5,760,542 | 6/1998 | Bechtel et al. | 313/491 |
| 5,818,407 | 10/1998 | Hori et al. | 345/92 |

*Primary Examiner*—Jeffery Brier
*Attorney, Agent, or Firm*—Dorsey & Whitney LLP

[57] ABSTRACT

A matrix addressable display includes an array of emitters aligned to respective regions of a cathodoluminescent layer. Each of the emitters is driven by a respective driving circuit in response to an image signal. Each of the driving circuits includes components selected according to an activation-to-emission response of the respective region of the cathodoluminescent layer. In one embodiment, the driving circuits include storage capacitors having capacitances that correspond to the activation-to-emission response of the region of the cathodoluminescent layer. In another embodiment, the driving circuits include identical capacitors that are charged and discharged in response to pulsed charging and driving signals. By adjusting the pulsed charging and driving signals, the amount of charge transferred to the emitter can be adjusted to compensate for the activation-to-emission response of the respective region of the cathodoluminescent layer.

32 Claims, 3 Drawing Sheets

MATRIX ADDRESSABLE DISPLAY HAVING COMPENSATION FOR ACTIVATION-TO-EMISSION VARIATIONS

STATEMENT AS TO GOVERNMENT RIGHTS

This invention was made with government support under Contract No. DABT-63-93-C-0025 by Advanced Research Projects Agency. The government has certain rights to this invention.

TECHNICAL FIELD

The present invention relates to matrix addressable displays, and more particularly to controlled excitation of light emission in matrix addressable displays.

BACKGROUND OF THE INVENTION

Flat panel displays are widely used in a variety of applications, including computer displays. One type of device well suited for such applications is the field emission display. Field emission displays typically are matrix addressable displays that include a generally planar substrate having an array of projecting emitters. In many cases, the emitters are conical projections integral to the substrate. Typically, the emitters are grouped into emitter sets where the bases of the emitters are commonly connected.

A conductive extraction grid is positioned above the emitters and driven with a voltage of about 30–120 V. The emitters are then selectively activated by providing a current path from the bases to ground. Providing a current path to ground allows electrons to be drawn from the emitters by the extraction grid voltage. If the voltage differential between the emitters and the extraction grid is sufficiently high, the resulting electric field extracts electrons from the emitters.

The field emission display also includes a display screen mounted facing the substrate. The display screen is formed from a glass plate coated with a transparent conductive material to form an anode biased to about 1–2 kV. A cathodoluminescent layer covers the exposed surface of the anode. The emitted electrons are attracted by the anode and strike the cathodoluminescent layer, causing the cathodoluminescent layer to emit light at the impact site. The emitted light then passes through the anode and the glass plate where it is visible to a viewer.

The brightness of the light produced in response to the emitted electrons depends, in part, upon the rate at which electrons strike the cathodoluminescent layer, which in turn depends upon the magnitude of current flow to the emitters. The brightness of each area can thus be controlled by controlling the current flow to the respective emitters. By selectively controlling current flow to each of the emitters, the light from each area of the display can be controlled and an image can be produced. The light emitted from each of the areas thus becomes all or part of a picture element or "pixel."

Typically, current flow to the emitters is controlled by controlling the voltage applied to the bases of the emitters to produce a selected voltage differential between the emitters and the extraction grid. The electric field intensity between the emitters and the extraction grid is then the voltage differential divided by the distance between the emitters and the extraction grid. The magnitude of the current to the emitters then corresponds to the intensity of the electric field.

One problem with the above-described approach is that the response of the emitters to applied grid and emitter voltages may be non-uniform. Typically, this is caused by variations in the separation between the emitters and the extraction grid across the array, which causes differences in the electric field intensity for a given voltage difference. Consequently, the rate of electron emission, and thus the light intensity, may vary across the display.

Additionally, the intensity of light emitted can vary in response to the activation-to-emission response of the cathodoluminescent layer. As used herein, activation-to-emission response refers to the amount of light energy emitted by the catiodoluminescent layer or a region of the cathodoluminescent layer for a given level of electron flow. A high activation-to-emission response then corresponds to emission of a relatively large amount of light energy for a given emitter current.

Variations in the cathodoluminescent layer thickness, or in the chemical makeup of the cathodoluminescent layer can cause variations in the activation-to-emission response of the cathodoluminescent layer, such that the intensity of emitted light can vary across the array even with a uniform distribution of electron flow. This is particularly common in color displays, in which the cathodoluminescent layer includes different phosphor formulations that produce light at red, green, or blue wavelengths. Each of the phosphor formulations can have a different activation-to-emission response. For example, red phosphor formulations typically have a higher activation-to-emission response than green phosphor formulations. The light intensity for a given current level will therefore be higher for red pixels than green pixels in the absence of corrective measures.

SUMMARY OF THE INVENTION

A current control circuit employs controlled charging and discharging of capacitive elements in a matrix addressable display for displaying an image in response to an image signal. In one embodiment, the capacitances of the capacitive elements are varied to compensate for activation-to-emission variations across the array. In another embodiment, the capacitive elements are charged and discharged at rates corresponding to a local activation-to-emission response.

In one embodiment, the matrix addressable display is a field emission display that includes an array of emitters surrounded by an extraction grid. The emitters are grouped into groups of three emitters controlled by an emitter current control circuit. The control circuit includes three separate driving circuits, each driving a respective emitter. Each of the three emitters is aligned to a respective red, green or blue region of a cathodoluminescent layer so that the three emitters form a color pixel.

The driving circuits establish the current available to respective emitters to control the emission of electrons from the emitters. The emitted electrons travel from the emitters through the extraction grid toward a transparent conductive anode at a much higher voltage than the voltage of the extraction grid. Electrons traveling toward the anode strike the cathodoluminescent layer, causing light to be emitted at the impact site. Because the brightness of the light depends upon the rate at which electrons are emitted by the emitters, the driving circuits control the brightness of the light by controlling current flow to the emitters.

Each of the driving circuits has an electrical response selected to correspond to the activation-to-emission response of the corresponding region of the cathodoluminescent layer. The electrical response is selected by choosing appropriate electrical components, such as storage capacitors, or by varying a clocking signal of the driving circuit.

In one embodiment, the driving circuits include serially connected pairs of NMOS transistors connected between respective column lines and emitters. The first NMOS transistor in each pair is a charging transistor coupled between the column line and a common node joining the pair of NMOS transistors. The second NMOS transistor is a driving transistor coupled between the common node in the emitter.

A charging signal and driving signal control the charging and driving transistors, respectively. The charging and driving signals are pulsed signals having one or more pulses during an activation interval of the respective emitter. The charging and driving signals are identical, except that the driving signal is phase delayed with respect to the charging signal, such that only one of the charging and driving transistors conducts at any time. Varying the pulse rate of the charging and driving signals produces a corresponding variation in the number of electrons emitted during an activation interval. Varying the pulse rate thus allows the driving circuit response to vary to offset variations in activation-to-emission response of the cathodoluminescent layer.

A discrete capacitor or a designed parasitic capacitance of the charging transistor at the common node stores a charge Q proportional to the voltage of the column line in response to each pulse of the charging signal. Once the capacitor or parasitic capacitance is charged, the charging signal pulse returns low and the charging transistor is turned OFF, trapping the charge Q on the parasitic capacitance. The pulse of the driving signal then turns ON the driving transistor to couple the common node to the emitter. The electrons stored in the parasitic capacitance during the charging period are thereby made available to the emitter. The number of electrons stored and transferred in response to each pulse pair is proportional to the capacitance of the capacitor or the parasitic capacitance. The capacitance of the driving circuit can then be selected to offset the activation-to-emission response of the cathodoluminescent layer.

In one embodiment of a display according to the invention, the discrete capacitance, the parasitic capacitance, and/or the number of pulses during an activation interval correspond to the activation-to-emission response of the region of the cathodoluminescent layer aligned to each emitter. For a low activation-to-emission response, the size of the discrete capacitor, the parasitic capacitance, and/or the number of pulses during each activation interval are increased to increase the number of electrons striking the cathodoluminescent layer during the activation interval. Conversely, for a high activation-to-emission response, the discrete capacitor, parasitic capacitance, and/or number of pulses in an activation interval are reduced to reduce the number of electrons striking the region of the cathodoluminescent layer during each activation interval.

DETAILED DESCRIPTION OF THE INVENTION

Figure 1:
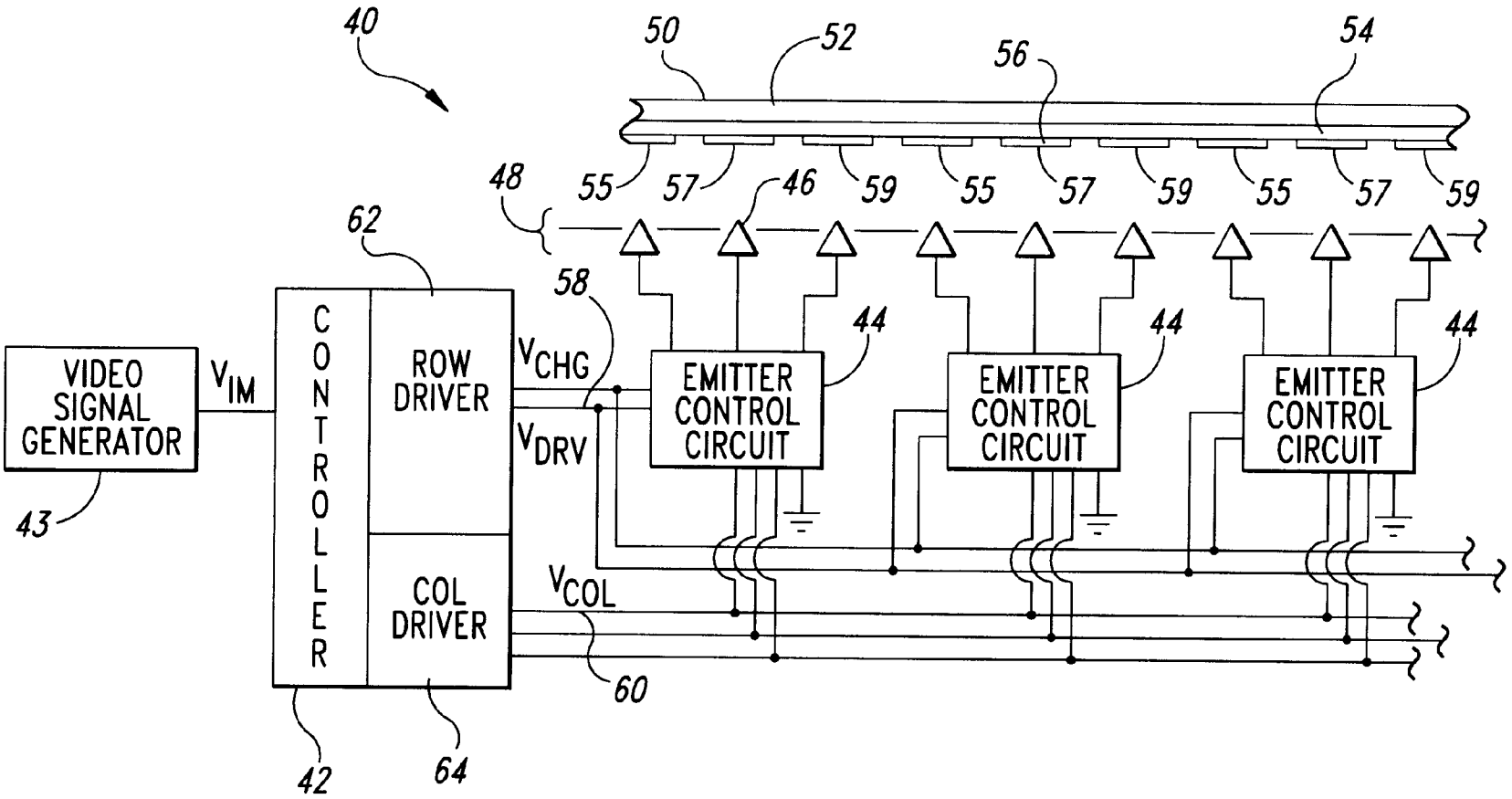
FIG. 1 is a diagrammatic representation of a portion of a field emission display according to a preferred embodiment of the invention showing three emitter control circuits each coupled to three emitters that are each aligned to a respective region of a cathodoluminescent layer.

As shown in FIG. 1, a display 40, which may be a television, computer display, or similar device, includes an electronic controller 42 that receives an image signal VM from a video signal generator 43. The video signal generator 43 can be a television receiver, camcorder, VCR, computer or any similar device that produces a video image signal $V_{IM}$ for a display. In response to the image signal $V_{IM}$, the controller 42 controls an array of emitter control circuits 44, each coupled to three respective emitters 46. While the array is represented by only three control circuits 44 and nine emitters 46 for clarity of presentation, it will be understood that typical arrays include several hundred control circuits 44 and emitters 46 arranged in rows and columns. Also, the term emitter as used herein can refer to a single emitter or a set of more than one emitters having commonly connected bases.

The emitters 46 are aligned with an extraction grid 48 adjacent a screen 50. The extraction grid 48 is a conventional extraction grid formed as a planar conductor having several holes, each aligned with a respective emitter 46. The screen 50 is a conventional screen formed from a glass plate 52 coated with a transparent, conductive anode 54 which is coated, in turn, by a cathodoluminescent layer 56. The cathodoluminescent layer 56 is divided into red, green and blue regions 55, 57, 59, respectively. Each of the regions 55, 57, 59 includes a distinct phosphor formulation, such that the regions 55, 57, 59 emit red, green or blue light, respectively, when stimulated.

During operation, the extraction grid 48 is biased to approximately 30–120 V and the anode 54 is biased to approximately 1–2 kV. A row driver 62 and column driver 64 within the controller 42 activate selected ones of the emitters 46 by selectively controlling the respective control circuits 44 through row lines 58 and column lines 60. In response, the control circuits 44 provide electrons to activate the emitters 46. The extraction grid 48 extracts the provided electrons by creating a strong electric field between the extraction grid and the emitter 46. The extracted electrons are attracted by the anode voltage and travel toward the anode 54. As the electrons travel toward the anode 54, they strike the cathodoluminescent layer 56, causing light emission at the impact site. The intensity of light can be controlled by controlling electron flow to the emitters 46, because the intensity of the emitted light corresponds in part to the number of electrons striking the cathodoluminescent layer 56 during a given activation interval.

Figure 2:
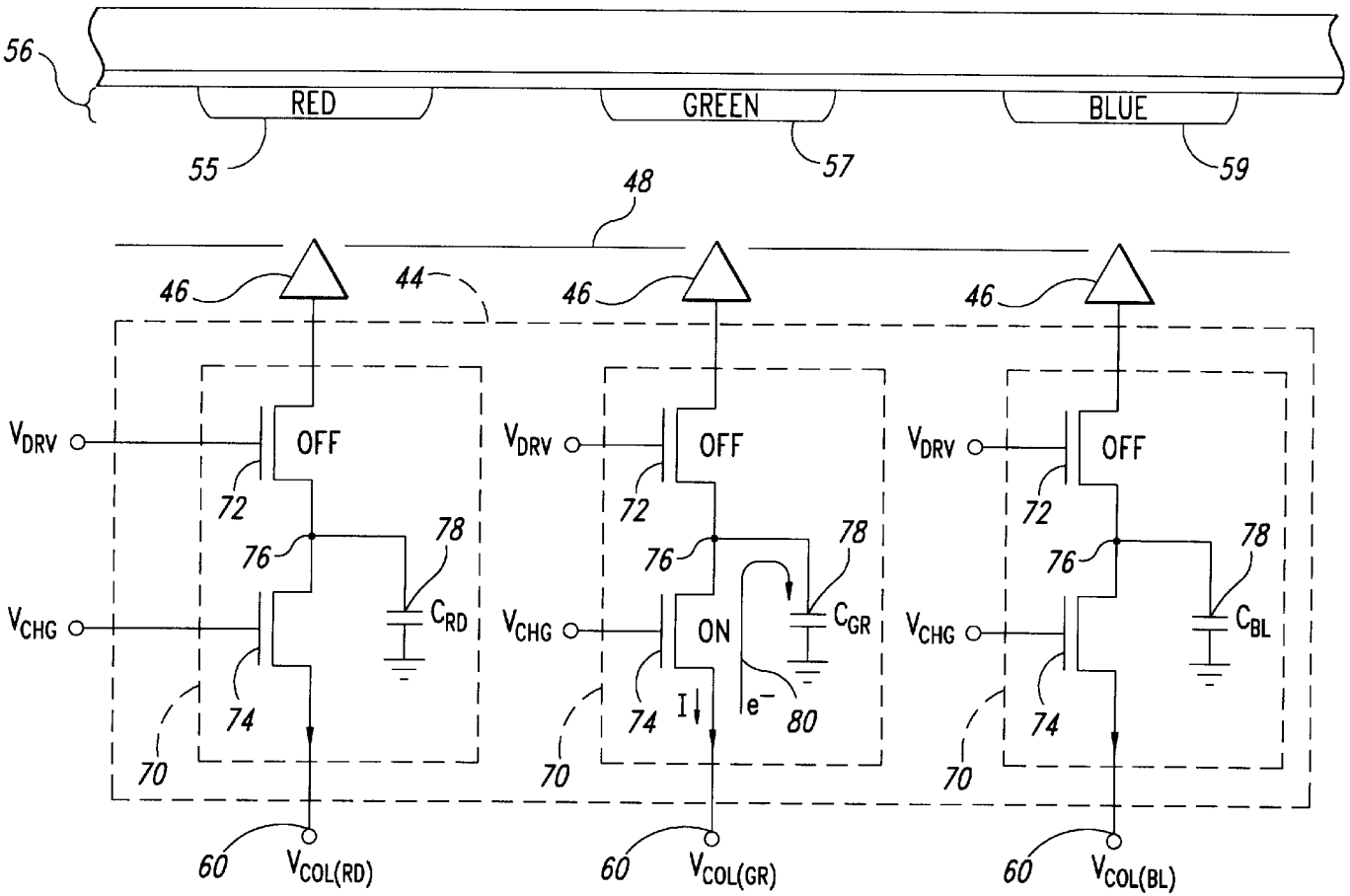
FIG. 2 is a schematic of one of the current control circuits in the display of FIG. 1 including three driving circuits for separate control of current to three emitters.
Figure 3:
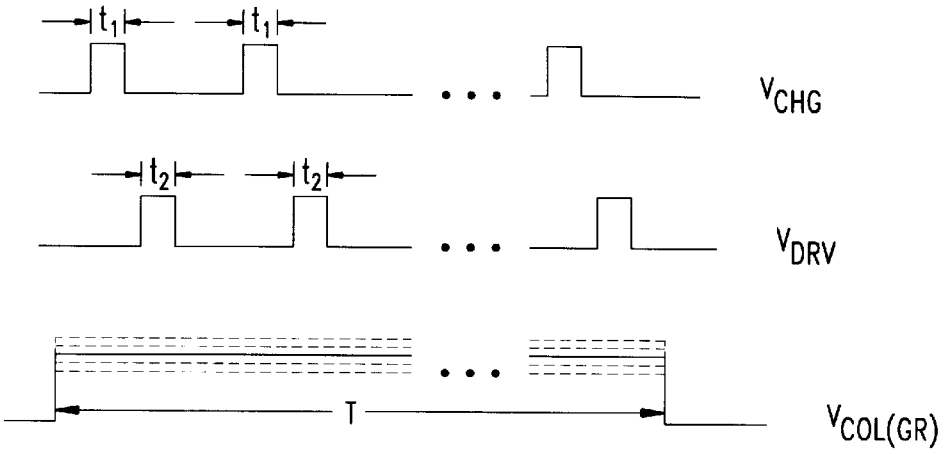
FIG. 3 is a signal tiring diagram showing the relative timing of charging and driving signals and a variable column signal for controlling an emitter set of the display of FIG. 1.

One approach to controlling electron flow to the emitter sets is shown in FIG. 2, where the control circuit 44 includes three driving circuits 70, each connected to a respective emitter 46 aligned to one of the red, green or blue regions 55, 57, 59. Each of the driving circuits 70 is formed from a respective driving NMOS transistor 72 and a charging NMOS transistor 74 serially coupled at a common node 76 between a respective column line 60 and emitter 46. Each driving circuit 70 is controlled by three signals from the controller 42, as shown in FIG. 3. The first two signals are pulsed charging and driving signals $V_{CHG}$, $V_{DRV}$. The charging and driving signals $V_{CHG}$, $V_{DRV}$ are identical, except that the driving signal $V_{DRV}$ is phased delayed with respect to the charging signal $V_{CHG}$, such that both signals $V_{CHG}$, $V_{DRV}$ will not be high at the same time, as can be seen in FIG. 3. The third signal is a red, green, or blue column signal $V_{COL(RD)}$, $V_{COL(GR)}$, or $V_{COL(BL)}$ (only the green column signal $V_{COL(GR)}$ is shown in FIG. 3) that provides a variable input voltage to the charging transistor 74. The controller 42 provides the column signal $V_{COL(RD)}$, $V_{COL(GR)}$, or $V_{COL(BL)}$ through the column driver 64 in response to chrominance information in the image signal $V_{IM}$.

Each of the driving circuits 70 is structurally the same, although, the electrical characteristics of the individual components and the clocking frequency and duty cycle of input signals can vary, as will be described below. Consequently, operation of only the middle driving circuit 70 will be described below.

The middle driving circuit 70 is connected to an emitter 46 that is aligned to a green section of the cathodoluminescent layer 56. Thus, the driving circuit 70 controls the green component of light emitted from the emitters 46 coupled to the control circuit 44 in response to the variable amplitude green column signal $V_{COL(GR)}$ (represented in broken lines in FIG. 3).

The gate of the charging transistor 74 is controlled by the charging signal $V_{CHG}$ such that the charging transistor is ON only during a charging interval $t_1$ when the charging signal $V_{CHG}$ is high. The gate of the driving transistor 72 is controlled by the driving signal $V_{DRV}$ such the driving transistor 72 is ON only during a driving interval $t_2$ different from the charging interval $t_1$. Because the driving signal $V_{DRV}$ is delayed with respect to the charging signal $V_{CHG}$, the charging and driving intervals $t_1$, $t_2$ do not overlap and, at most, one of the transistors 72, 74 is ON at any time.

The remaining element of the driving circuit 70 is a circuit capacitance represented as a capacitor 78 coupled between the common nodes 76 and ground. The capacitor 78 preferably is not a separate circuit element. When the transistor 72, 74 are integrated into a substrate (not shown in FIG. 2), parasitic capacitances are inherent at the common node 76. Cumulatively, the parasitic capacitances provide sufficient capacitance for operation of the driving circuit 70 because of the low current requirements of the emitter 46. The structures of the transistors 72, 74 can be designed according to known techniques such that the inherent parasitic capacitances can vary between the three driving circuits 70. The parasitic capacitances may also be supplemented by a fixed capacitance. For convenience of presentation, the effects of the parasitic capacitances and any supplemental capacitors are represented as single, discrete capacitors 78 in FIG. 2.

The operation of the driving circuit 70 will now be described with reference to FIGS. 1, 3 and 4 and the middle driving circuit 70 of FIG. 2. First, the column driver 64 (FIG. 1) sets the magnitude of the column signal $V_{COL(GR)}$ (FIG. 3) at a voltage level inversely proportional to the intensity of the green chrominance portion of the image signal $V_{IM}$ (FIG. 1). Then, during the charging interval $t_1$, the charging signal $V_{CHG}$ is high, turning ON the charging transistor 74. At the same time, the driving signal $V_{DRV}$ is low, turning OFF the driving transistor 72, such that the driving transistor 72 isolates the capacitor 78 from the emitter 46. The charging transistor 74 thus couples the column signal $V_{COL(GR)}$ to the common node 76, pulling the capacitor voltage $V_{C(GR)}$ down to the voltage of the column signal $V_{COL(GR)}$. As will be explained hereinafter, prior to the charging interval $t_1$, the capacitor voltage $V_{C(GR)}$ is higher than the voltage of the column signal $V_{COL(GR)}$. Consequently, when the charging transistor 72 is ON, electrons flow from the column line 60 to the capacitor 78, as indicated by the arrow 80 in FIG. 2.

At the end of the charging interval $t_1$, the charging signal $V_{CHG}$ returns low and both transistors 72, 74 are OFF. Because the transistors 72, 74 are NMOS transistors having extremely low current leakage, the charge Q on the capacitor 78 is trapped and the capacitor voltage $V_{C(GR)}$ remains constant at the voltage of the column signal $V_{COL(GR)}$.

Figure 4:
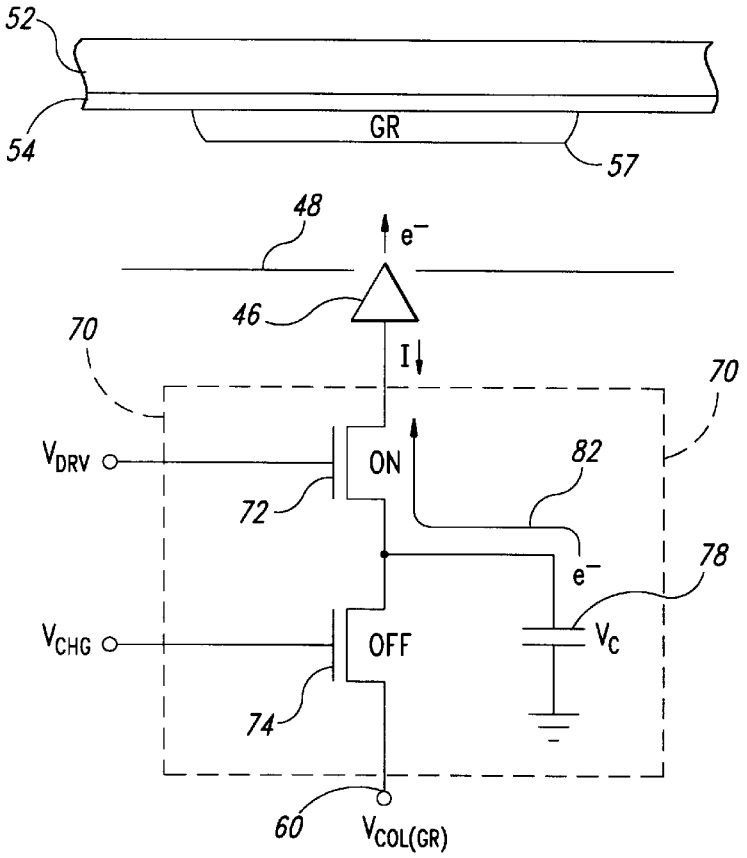
FIG. 4 is a schematic of a portion of the control circuit of FIG. 3 showing electron flow during a driving interval.

Next, during the driving interval $t_2$, the driving signal $V_{DRV}$ goes high and turns ON the driving transistor 72, as represented in FIG. 4. By this time, the charging signal $V_{CHG}$ is low such that charging transistor 74 is OFF, isolating the column line 60 from the common nodes 76. The ON driving transistor 72 couples the electrons from the capacitor 78 to the emitter 46, as indicated by the arrow 82. The electric field between the extraction grid 48 and the emitters 46 extracts electrons from the emitter 46.

As electrons are extracted from the emitter 46 and electrons stored in the capacitor 78 are depleted, the capacitor voltage $V_{C(GR)}$ rises and approaches the voltage of die driving signal $V_{DRV}$. When the difference between the capacitor voltage $V_{C(GR)}$ and the voltage of the driving signal $V_{DRV}$ reaches the threshold voltage $V_T$ of the driving transistor 72, the driving transistor 72 turns OFF. For example, for a driving signal voltage of 5 V, a column voltage $V_{COL(GR)}$ of 2 V and a threshold voltage $V_T$ of 1 V, the capacitor voltage $V_{C(GR)}$ will go from 2 V ($V_{COL(GR)}$) to 4 V ($V_{DRV}$ minus $V_T$). The change in voltage $\Delta V_{C(GR)}$ across the capacitor 78 will then equal 2 V. The total charge from electrons emitted by the emitter 46 equals the change in voltage $\Delta V_{C(GR)}$ times the capacitance $C_{(GR)}$ of capacitor 78 ($\Delta Q = C_{AVC(GR)} = C\ (2\ V)$), which is in turn a function of the difference between the voltages of the driving signal $V_{DRV}$ and the column signal $V_{COL(GR)}$. Thus, the number of electrons emitted in response to each pair of pulses can be controlled by controlling the voltages of the column and driving signals $V_{COL(GR)}$, $V_{DRV}$.

The total charge transfer during the activation interval is determined in part by the capacitance $C_{(GR)}$ of the capacitor 78. Thus, if size of the capacitor $C_{(GR)}$ of the capacitor 78 is increased, the total charge transferred during an activation interval will be increased. Each of the driving circuits 70 in the control circuit 44 includes its own capacitor 78 (i.e., a separate, designed-in parasitic capacitance). Consequently, the capacitance of each of the driving circuits 70 can be established separately.

To determine the appropriate capacitance $C_{(RD)}$, $C(_{GR)}$, $C_{(BL)}$ for the red, green and blue driving circuits 70, the relative activation-to-emission responses of the cathodoluminescent layer 56 are determined. Then, the relative capacitances $C_{(RD)}$, $C_{(GR)}$, $C_{(BL)}$ are selected with relative sizes inverse to the activation-to-emission responses of their corresponding regions 55, 57, 59. To address variations in the activation-to-emission response of the cathodoluminescent layer 56 as a whole or to control the brightness level of the display 40, the pulse rate of the charging and driving signals $V_{CHG}$, $V_{DRV}$, the amplitude of the driving signal $V_{DRV}$, or the amplitude of the column signal $V_{COL(GR)}$, $V_{COL(RD)}$, $V_{COL(BL)}$ can be varied.

As an alternative or complement to controlling the brightness by controlling the voltages of the column signal $V_{COL(GR)}$ and driving signal $V_{DRV}$, the brightness can be controlled by controlling the number of pulse pairs in the activation interval T. As shown in FIG. 3, the activation interval T defines the time over which an emitter 46 is activated. That is, the activation interval T is the time during which the column signal $V_{COL(GR)}$ is available on the column line 60. The activation interval T is substantially longer than the charging and driving intervals $t_1$, $t_2$. Consequentially, several pairs of pulses can arrive within one activation interval T, allowing the capacitor 78 to charge and discharge several times. The total transferred charge QTOT in the activation interval T will equal the number N of pulse pairs in the activation interval T times the capacitance $C_{(GR)}$ of the capacitor 78 times the change in the capacitor voltage $\Delta V_{C(GR)}$. Thus, for a given voltage change, the number of electrons emitted by the emitter 46 can be controlled by varying the number of pulse pairs N within the activation interval T and/or by controlling the voltage of the column signal $V_{COL(GR)}$.

Although the present invention has been presented herein by way of exemplary embodiments, various modifications may be made without departing from the spirit and scope of the invention. For example, a variety of other driving circuit structures having variable circuit components may be incorporated in the control circuits 44. In one example of this approach, the threshold voltage $V_T$ of the driving transistors 72 can be varied among the three driving circuits 70. Alternatively, each of the driving circuits 70 can include a resistor coupled between the emitter 46 and the driving transistor 72 or between the charging transistor 74 and ground. In either case, the resistor limits the amount of charge transferred from, or to, the capacitor 78 during the pulses of the driving and charging signals $V_{CHG}$, $V_{DRV}$, respectively. The value of the resistor can then be varied to address activation-to-emission variations of the red, green, and blue regions 55, 57, 59 of the cathodoluminescent layer 56. Other configurations of the driving circuit 70 incorporating resistors or other types of components can also be realized within the scope of the invention. Moreover, the number of pulses of charging and driving signals $V_{CHG}$, $V_{DRV}$ during each activation interval can be varied separately among the driving circuits 70 to adjust the relative levels of the red, green and blue light. For example, the red light intensity can be increased by increasing the pulse rate of the red charging signal $V_{CHG(RD)}$ and red driving signal $V_{DRV(RD)}$, relative to the pulse rate of the green and blue charging signals $V_{CHG(GR)}$, $V_{CHG(BL)}$ and driving signals $V_{DRV(GR)}$, $V_{DRV(BL)}$. Accordingly, the invention is not limited except as by the appended claims.

What is claimed is:

1. A matrix addressable display comprising:

an array including a plurality of light emitting assemblies wherein a first of the light emitting assemblies has a first light emission response and a second light emitting assembly has a second light emission response different from the first light emitting assembly, each of the light emitting assemblies including a respective region of a light emissive layer;

a first driving circuit coupled to the first light emitting assemblies, the first driving circuit having a first component having a first component value, and a second driving circuit having a second circuit component of common type to the first component and having a second component value different from the first component value, wherein the first light emitting assembly includes a first region of a red light emissive material and the second light emitting assembly includes a green light emissive material and wherein the component value of the first circuit component is selected to correspond to an activation-to-emission response of the red light emissive material and the component value of the second circuit component is selected to correspond to an activation-to-emission response of the green light emissive material.

2. The matrix addressable display of claim 1 wherein the first and second circuit components are capacitors and the first capacitor has a greater capacitance than the second capacitor.

3. A field emission display for producing an image in response to an image signal, comprising:

a display screen;

a cathodoluminescent layer carried by the screen, the layer including a first material in a first region responsive to emit light in a first band and a second material in a second region responsive to emit light in a second band different from the first band wherein the first material and the second material have respective excitation-to-emission responses;

a first emitter aligned to the first region;

a second emitter aligned to the second region;

a first driving circuit coupled to drive the first emitter, the first driving circuit having electrical components selected to correspond to the first excitation-to-emission response; and a second driving circuit coupled to drive the second emitter set, the second driving circuit having electrical components selected to correspond to the second excitation-to-emission response.

4. The field emission display of claim 3 wherein the electrical first and second driving circuits include first and second storage circuits respectively for storing image samples.

5. The field emission display of claim 4 wherein the storage circuits include first and second capacitors.

6. The field emission display of claim 5 wherein the first capacitor has a first capacitance selected to correspond to the excitation-to-emission response of the first material and the second capacitor has a second capacitance selected to correspond to the excitation-to-emission response of the second material, and wherein the first and second capacitances are different.

7. The field emission display of claim 5 wherein the first and second capacitors are parasitic capacitances.

8. An apparatus for displaying an image, comprising:

a video signal generator operative to produce an image signal having selected color components; and a matrix addressable display, including:

a display screen having first and second regions of light emissive material, the first region having a first activation-to-emission response and the second different region having a second activation-to-emission response different from the first activation-to-emission response;

an array including a plurality of activating assemblies each aligned to a respective region of the display light emitting assembly;

a first driving circuit coupled between the video signal generator and a first of the activating assemblies, the first driving circuit having a first circuit component having a first component value selected to produce a first electrical response corresponding to the first activation-to-emission response; and a second driving circuit coupled between the video signal generator and a second of the activating assemblies, the second driving circuit having a second circuit component of common type as the first circuit component and having a second component value different from the first component value and selected to produce a second electrical response corresponding to the second activation-to-emission response.

9. The apparatus for displaying an image of claim 8 wherein the first and second circuit components are capacitors and the first capacitor has a greater capacitance than the second capacitor.

10. The apparatus for displaying an image of claim 9 wherein the first and second capacitors are parasitic capacitances.

11. The apparatus for displaying an image of claim 8 wherein the video signal generator includes a first clock signal generator for producing a first clock signal and a second clock signal generator for producing a second clock signal.

12. The apparatus for displaying an image of claim 11 wherein the first clock signal generator is configured to produce the first clock signal at a first frequency and the second clock signal generator is configured to produce the second clock signal at a second frequency different from the first frequency.

13. The apparatus for displaying an image of claim 12 wherein the first frequency and the second frequency correspond to the first and second activation-to-emission responses, respectively.

14. The apparatus for displaying an image of claim 11 wherein the first clock signal generator is configured to produce a first number of pulses during an activation interval of the first activating assembly and the second clock signal generator is configured to produce a second number of pulses during an activation interval of the second activating assembly.

15. The apparatus for displaying an image of claim 14 wherein the first and second numbers correspond to the first and second activation-to-emission responses, respectively.

16. A method of producing a color adjusted signal in a display having first and second regions of light emissive material, each having a respective activation-to-emission response, comprising the steps of:

receiving an image signal;

extracting first and second signal components from the image signal;

producing a first excitation signal in response to the extracted first signal component;

producing a second excitation signal in response to the extracted second signal component;

pulsing a first driving circuit a first number of times during an activation interval of the first region wherein the first number is a function of the first activation-to-emission response;

exciting the first region in response to the first excitation signal and the pulsing of the first driving circuit;

pulsing the second driving circuit a second number of times during an activation interval of the second region wherein the second number is a function of the second activation-to-emission response; and exciting the second region in response to the second excitation signal and the pulsing of the second driving circuit.

17. The method of claim 16 wherein the display includes first and second storage circuits each having a different storage capacity, wherein the step of exciting the first region in response to the first excitation signal and the pulsing of the first driving circuit comprises the step of charging the first storage circuit in response to the pulsing of the first driving circuit and wherein the step of exciting the second region in response to the second excitation signal and the pulsing of the second driving circuit comprises the step of charging the second storage circuit in response to the pulsing of the second driving circuit.

18. The method of claim 16 wherein the step of exciting the first region in response to the first excitation signal and the pulsing of the first driving circuit in response to the extracted first signal component further comprises the steps of transferring charge from the first storage circuit to a first emitter in response to the pulsing of the first driving circuit.

19. The method of claim 16 wherein the first and second storage circuits have different storage capacities.

20. The method of claim 16 farther comprising the steps of:

selecting the first number according to the activation-to-emission response of the first region of light emissive material; and selecting the second number according to the activation-to-emission response of the second region of light emissive material.

21. A method of producing a color adjusted signal in a display having a first and second regions of light emissive material, each having a respective activation-to-emission response, comprising the steps of:

receiving an image signal;

extracting first and second color signal components from the image signal;

producing a first excitation signal in response to the extracted first color signal component;

producing a second excitation signal in response to the extracted second color signal component;

activating a first driving circuit in response to the first excitation signal without adjusting the first excitation signal for the first activation-to-emission response;

exciting the first region at a level adjusted for the first activation-to-emission response in response to the unadjusted first excitation signal;

activating a second driving circuit in response to the second excitation signal without adjusting the second excitation signal for the second activation-to-emission response; and exciting the second region at a level adjusted for the second activation-to-emission response in response to the unadjusted second excitation signal.

22. The method of claim 21 wherein the first and second driving circuits include first and second storage circuits, respectively, each storage circuit having a different storage capacity, wherein the step of activating the first driving circuit in response to the first excitation signal without adjusting the first excitation signal for the first activation-to-emission response comprises the step of charging the first storage circuit and wherein the step of activating the second region in response to the second excitation signal without adjusting the second excitation signal for the second activation-to-emission response comprises the step of charging the second storage circuit.

23. The method of claim 21 wherein the step of exciting the first region at a first level in response to the unadjusted first excitation signal comprises the steps of:

producing first and second clocking signals;

transferring charge to a first storage circuit in response to the first clocking signal; and transferring charge from the first storage circuit to a first emitter in response to the second clocking signal.

24. The method of claim 23 wherein the step of exciting the second region at a second, level in response to the unadjusted second excitation signal comprises the steps of:

producing third and fourth clocking signals;

transferring charge to a second storage circuit in response to the third clocking signal; and transferring charge from the second storage circuit to a second emitter in response to the fourth clocking signal.

25. The method of claim 24 wherein the first and second storage circuit have different storage capacities.

26. The method of claim 25 wherein the first, second, third and fourth clocking signals have the same frequencies.

27. The method of claim 26 wherein the first and second clocking signals have a first frequency and the third and fourth clocking signals have a second frequency different from the first frequency.

28. The method of claim 24 wherein the first and second storage circuits have the same storage capacities.

29. The method of claim 28 wherein the first and second clocking signals have a first frequency and the third and fourth clocking signals have a second frequency different from the first frequency.

30. The method of claim 29 further comprising the steps of:

selecting the first frequency according to the activation-to-emission response of the first region of light emissive material; and selecting the second frequency according to the activation-to-emission response of the second region of light emissive material.

31. A method of producing a color adjusted signal in a field emission display having a first and second regions of light emissive material, each having a respective activation-to-emission response, the field emission display including an array of emitters wherein a first emitter is aligned to the first region and a second emitter is aligned to the second region, comprising the steps of receiving an image signal;

extracting first and second signal components from the image signal;

producing a first excitation signal in response to the extracted first signal component;

producing a second excitation signal in response to the extracted second signal component;

pulsing a first driving circuit a first number of times during an activation interval of the first region wherein the first number is a function of the first activation-to-emission response;

transferring a first quantity of charge to the first emitter in response to the first excitation signal and the pulsing of the first driving circuit;

pulsing the second driving circuit a second number of times during an activation interval of the second region wherein the second number is a function of the second activation-to-emission response; and transferring a second quantity of charge to the second emitter in response to the second excitation signal and the pulsing of the second driving circuit.

32. The method of claim 31 wherein the display includes first and second storage circuits each having a different storage capacity, wherein the step of transferring charge to the first emitter comprises the step of charging and discharging the first storage circuit in response to the pulsing of the first driving circuit and wherein the step of transferring charge to the second emitter comprises the step of charging and discharging the second storage circuit in response to the pulsing of the second driving circuit.

* * * * *

UNITED STATES PATENT AND TRADEMARK OFFICE

CERTIFICATE OF CORRECTION

PATENT NO. : 6,028,576
DATED : February 22, 2000
INVENTOR(S) : Glen E. Hush

It is certified that error appears in the above-identified patent and that said Letters Patent is hereby corrected as shown below:

Title page,
Item [56], References Cited, US PATENT DOCUMENTS, please add
-- 3,761,617 9/1973 Tsuchiya et al. --
-- 3,883,778 5/1975 Kaji et al. --
-- 4,743,096 5/1988 Wakai et al. --
-- 5,103,144 4/1992 Dunham --
-- 5,153,483 10/1992 Kishino et al. --
-- 5,196,839 3/1993 Johary et al. --
-- 5,210,472 5/1993 Casper et al. --
-- 5,212,426 5/1993 Kane --
-- 5,283,500 2/1994 Kochanski --
-- 5,359,256 10/1994 Gray --
-- 5,404,081 4/1995 Kane et al. --

OTHER PRIOR ART, please add
-- Cathey, David A., Jr. "Field Emission Displays" <no citation information> --
-- Lee, Kon Jiun "Current Limiting of Field Emitter Array Cathodes," pp. 88-156 of Ph.D. Thesis, Georgia Institute of Technology, 1986. --
-- Yokoo, K.; Arai, M.; Mori, M.; Bae, J.; Ono, S. "Active Control of Emission Current of Field Emitter Array," *Revuew "Le Vide, les Couches Minces"* Suppl. No. 271:58-61, March/April, 1994 --

UNITED STATES PATENT AND TRADEMARK OFFICE

CERTIFICATE OF CORRECTION

PATENT NO. : 6,028,576
DATED : February 22, 2000
INVENTOR(S) : Glen E. Hush

It is certified that error appears in the above-identified patent and that said Letters Patent is hereby corrected as shown below:

Column 10,
Line 9, reads "claim 16 farther" should read -- claim 16 further --
Line 63, reads "at a second, level in response" should read -- at a second level in response --

Signed and Sealed this

Eleventh Day of December, 2001

*Attest:*

Nicholas P. Godici

NICHOLAS P. GODICI
*Acting Director of the United States Patent and Trademark Office*

*Attesting Officer*